US005304013A

United States Patent [19]

Parsons

[11] Patent Number: 5,304,013

[45] Date of Patent: Apr. 19, 1994

[54] ROAD SHOULDER COMPACTING APPARATUS

[76] Inventor: Harold Parsons, 6195 Cottonwood Street, Delta, B.C., Canada, V4E 3K5

[21] Appl. No.: 911,721

[22] Filed: Jul. 10, 1992

[51] Int. Cl.[5] ..... E01C 19/26

[52] U.S. Cl. ..... 404/127; 404/128

[58] Field of Search ..... 404/127, 128, 130

[56] References Cited

U.S. PATENT DOCUMENTS

| | | | |
|---|---|---|---|
| 2,386,025 | 10/1945 | Wills | 404/128 X |
| 3,146,686 | 9/1964 | Grace et al. | 404/128 X |
| 4,422,296 | 12/1983 | Tavernier | 404/128 |
| 4,702,644 | 10/1987 | Cioffi | 404/128 |

*Primary Examiner*—William P. Neuder
*Attorney, Agent, or Firm*—Brian M. Long

[57] ABSTRACT

In a vehicle equipped with a road shoulder compacting apparatus, the apparatus includes a ground engagement member for rolling engagement with a shoulder of a road as the vehicle travels along the road, and a support structure carrying the ground engagement member on the vehicle and including an adjustable connection between the vehicle and the ground engagement member. The adjustable connection permits displacement of the ground engagement member from one side to the other of the vehicle and vice versa, so that the ground engagement member can be utilized at opposite sides of the vehicle. A selectively adjustable mechanism is provided for raising and lowering the ground engagement member into and out of engagement with the ground.

6 Claims, 5 Drawing Sheets

ROAD SHOULDER COMPACTING APPARATUS

BACKGROUND OF THE INVENTION

1. Field of the Invention

The present invention relates to a ground compacting apparatus, and more particularly, to apparatus for compacting the shoulder of a road.

2. Description of Related Art

In the construction and maintenance of roads, gravel and other materials are distributed along the shoulders of the roads. Since such shoulders are soft shoulders, and therefore should not be subjected to the weight of a vehicle, particularly before the thus-deposited material has not yet consolidated, it is desirable to compact this material by means of a vehicle travelling along the road but not along the shoulder.

Hither to, such road shoulders have not normally been compacted. In some cases, a grader wheel has been run along the shoulder, which has the disadvantage that the grader wheel caused a water rut. Some road construction contractors have made the shoulder higher than the pavement, and they have run a heavy compactor over the should, but this had the disadvantage that the compactor compacted the pavement more than the shoulder, thus causing damage to the pavement.

SUMMARY OF THE INVENTION

It is accordingly an object of the present invention to provide a novel and advantageous ground compacting apparatus which can be used to compact the shoulder of a road by means of a vehicle travelling along the road but not along the shoulder.

According to the present invention, a road shoulder compacting apparatus, for use on a vehicle, has a rotatable ground engagement member for rolling compacting engagement with ground at a location offset to one side of the vehicle, a support structure for carrying the ground engagement member at the side of the vehicle and a selectively adjustable mechanism for lowering and raising the ground engagement member into and out of engagement with the ground.

With this apparatus, as the vehicle travels along the road, the ground engagement member, offset to one side of the vehicle, can be rolled along the shoulder of the road for the purpose of compacting the road shoulder. When the compacting operation has been completed, the ground engagement member can be raised from the road to facilitate the travel of the vehicle to a new location.

Preferably, the support structure is adjustable so that the ground engagement member can be moved from one side to the other of the vehicle, which enables the width of the vehicle to be kept under the prescribed maximum width permissible for travel on roads and which also enables the vehicle and the apparatus to compact the shoulder at either side of the road without reversing the direction of travel of the vehicle along the road.

In a preferred embodiment of the invention, the ground engagement member is carried at a free end of a horizontal arm forming part of the support structure, the opposite end of the arm having a pivotal connection allowing the arm to pivot about a vertical axis, located at least substantially midway between the opposite sides of the vehicle, for displacing the ground engagement member between operational positions disposed at opposite sides of the vehicle.

The adjustable mechanism for raising and lowering the ground engagement member may take the form of a parallel motion linkage between the support structure and one end of the vehicle, this linkage allowing vertical displacement of the support structure by means of a piston and cylinder device.

A further piston and cylinder device may be provided for adjustably tilting the ground engagement member about a horizontal axis of a pivotal connection between a stub shaft carrying the ground engagement member and the free end of the support structure arm.

BRIEF DESCRIPTION OF THE DRAWINGS

Further objects, features and advantages of the present invention will become more readily apparent to those skilled in the art from the following description of the invention when taken in conjunction with the accompanying drawings, in which.

DESCRIPTION OF THE PREFERRED EMBODIMENT

Figure 1:
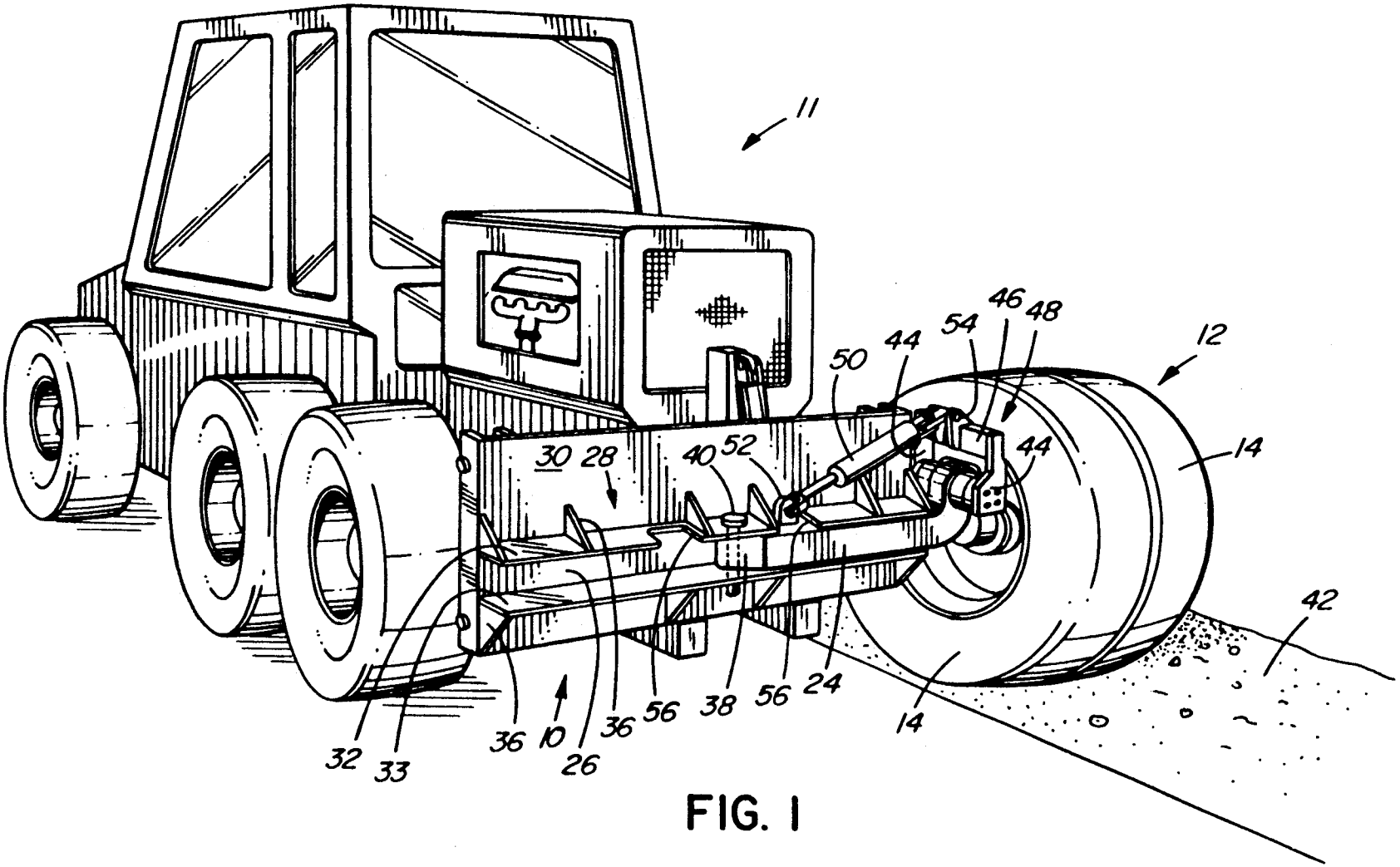
FIG. 1 shows a view in perspective of a tractor provided with a road shoulder compacting apparatus according to the present invention.
Figure 2:
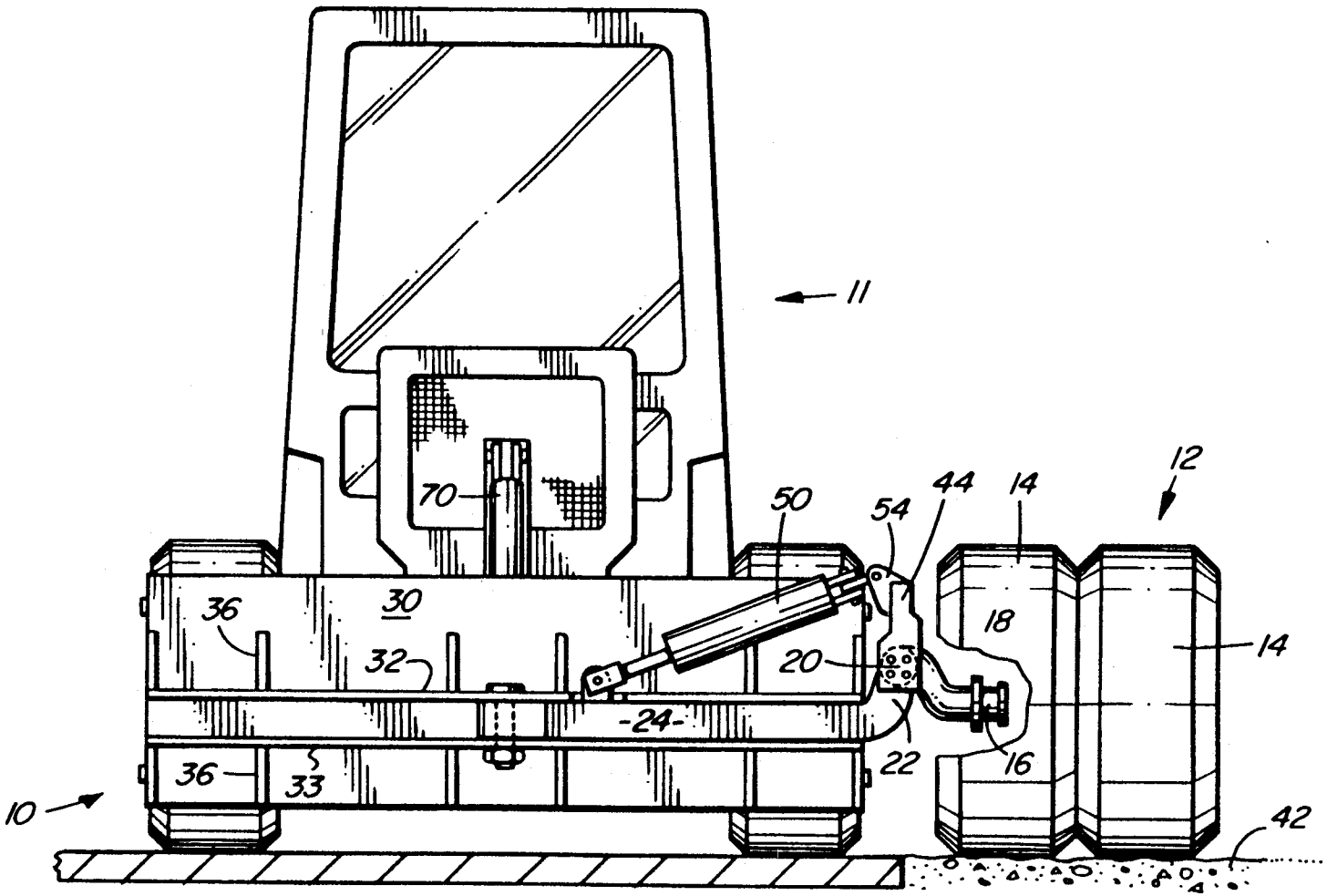
FIG. 2 shows a view in front elevation of the tractor and road shoulder compacting apparatus of FIG. 1.

Referring firstly to FIGS. 1 and 2 of the accompanying drawings, reference numeral 10 indicates generally a road shoulder compacting apparatus mounted on the rear end of a vehicle, e.g. a grader or paver unit, which is indicated generally by reference numeral 11. It is, however, to be understood that the road shoulder compacting apparatus could alternatively be mounted on the rear of vehicle 11.

The road shoulder compacting apparatus 10 has a ground engagement member, indicated generally by reference numeral 12, in the form of a pair of rubber-tired wheels 14, which can carried on an axle with form a stub shaft 16.

The stub shaft 16 has an upturned free end 18 which is connected, by means of a pivot connection 20 having a substantially horizontal axis of pivotation, to an upturned end portion 22 of a horizontally extending support arm 24.

As shown in FIGS. 1 and 2, the arm 24 is received in a forwardly horizontally open recess 26, which is formed by a channel-shaped structure, indicated generally by reference numeral 28.

More particularly, the channel-shaped structure 28 is defined by a vertical backplate 30, and two vertically spaced, horizontally extending, elongate sheet metal members 32 and 33, which are fixed to the backplate 30 by welding and reinforced by triangular reinforcement plates 36, welded to the backplate 30 and to the sheet metal members 32 and 33.

The arm 24 has an end 38, opposite from the upturned end portion 22, which is secured to the sheet metal members 32 and 33 by means of a pivot connection 40.

The pivot connection 40 has a vertical axis of pivotation located substantially midway between the opposite ends of the channel-shaped structure 28, and midway between opposite sides of the vehicle 11. The arm 24 can pivot horizontally, about this vertical axis of pivotation of the pivotal connection 40, as diagrammatically illustrated in FIG. 3, through an angle of 180° between end positions in which the arm 24 extends transversely of the apparatus to move the ground engagement member 12 from the right-hand side of the vehicle 11, as viewed in FIGS. 2 and 3, to an opposite operational position at the left-hand side of the vehicle 11.

The backplate 30, the sheet metal members 32 and 33, and the pivotal connection 40 form parts of a support structure which carries the arm 24 and the ground engagement member 12. This support structure can be displaced vertically as described below, to raise the ground engagement member 12 from the position in which it is shown in FIGS. 1 and 2, and in which it is in engagement with a road shoulder 42, to a raised position, in which the ground engagement member 12 is lifted out of engagement with the road shoulder 42.

Figure 3:
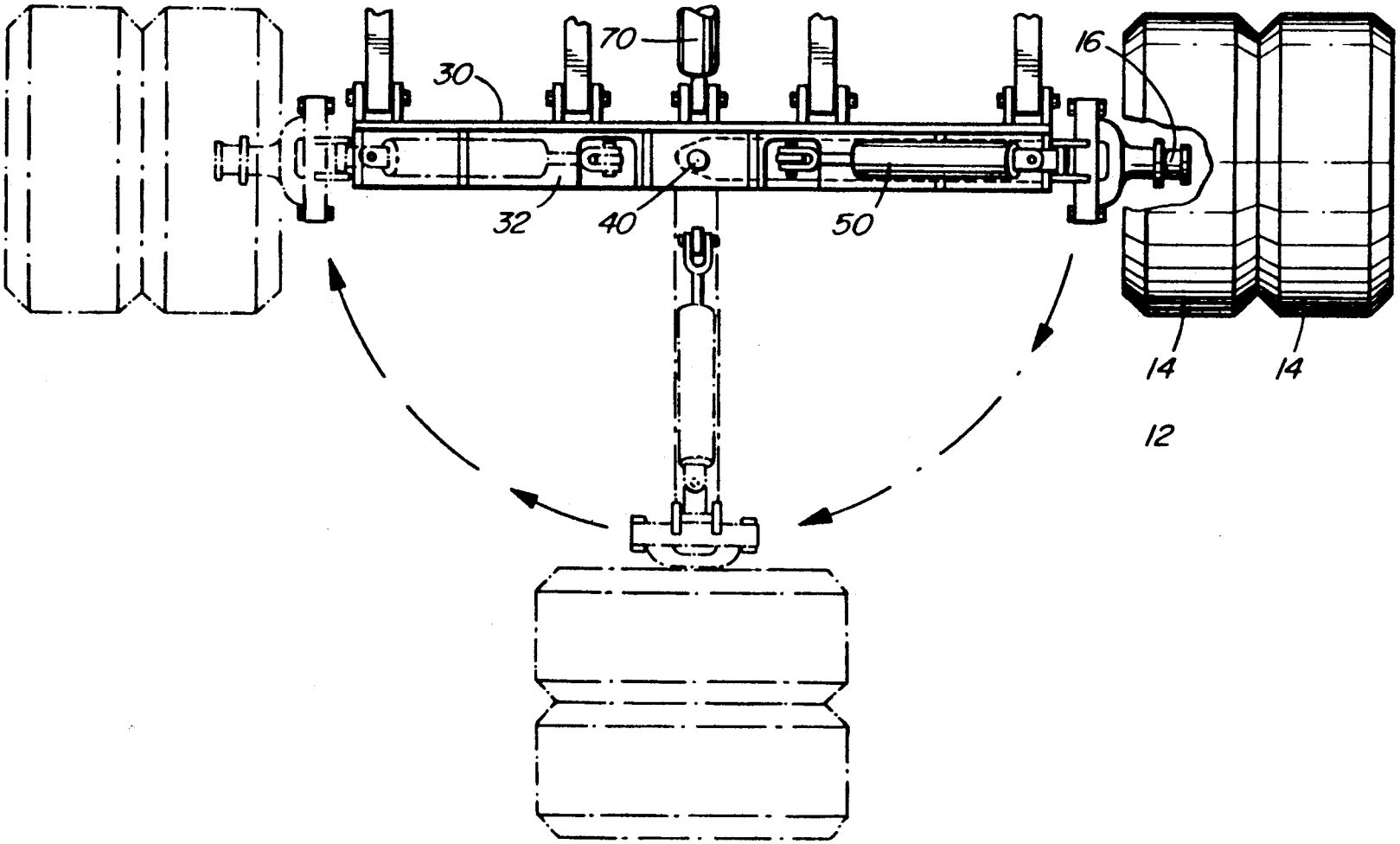
FIG. 3 shows a plan view of the road shoulder compacting apparatus of FIGS. one and 2.

As can be seen from FIG. 3, the ground engagement member 12 is spaced laterally from the support structure when the arm 24 is in its end positions.

The upturned end portion 18 of the stub shaft 16 of the ground engagement member 12 is fixedly connected to a pair of lever arms 44, the upper ends of which are connected to one another by a cross-brace 46 to form a yoke, indicated generally by reference numeral 48.

Figure 4:
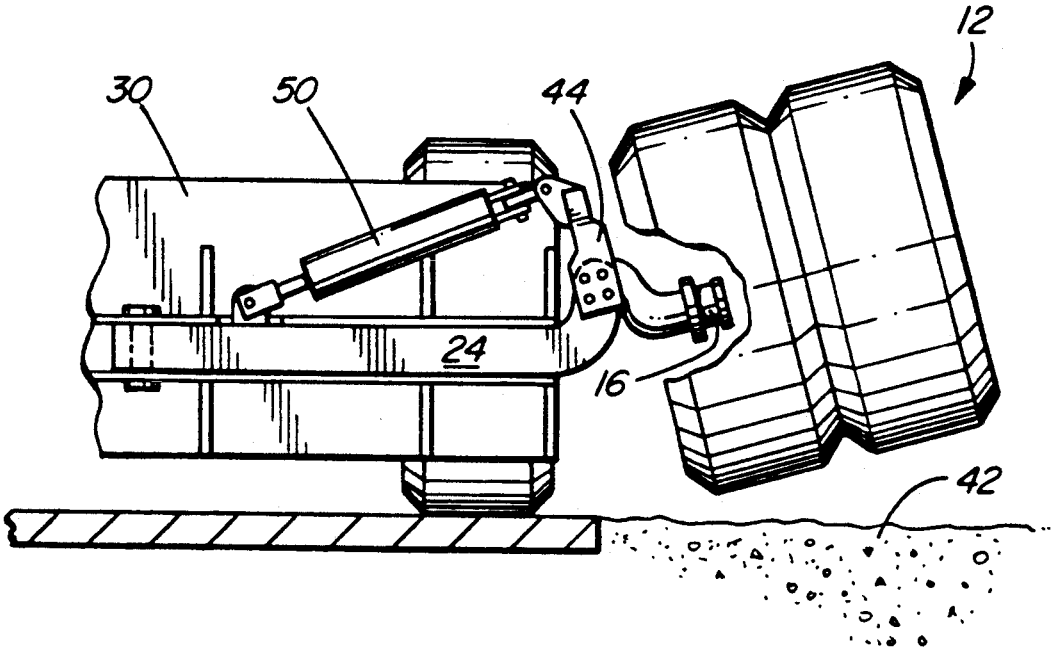
FIG. 4 shows a broken-away view, in front elevation, of parts of the compacting apparatus of FIGS. 1 to 3, with the ground engagement member tilted into a raised position.
Figure 5:
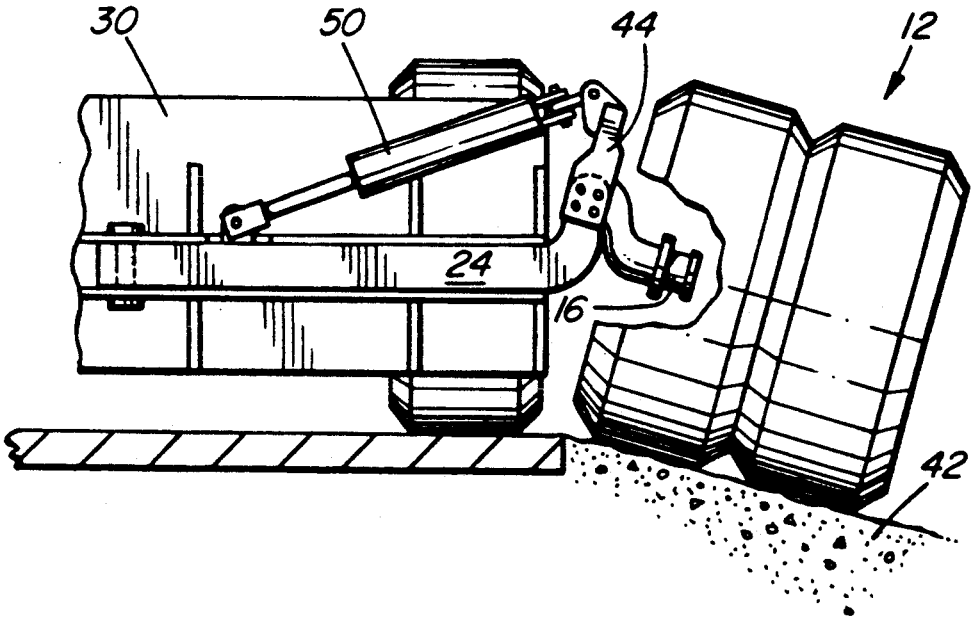
FIG. 5 shows a view corresponding to FIG. 4, but with the ground engagement member lowered into contact with the ground.
Figure 7:
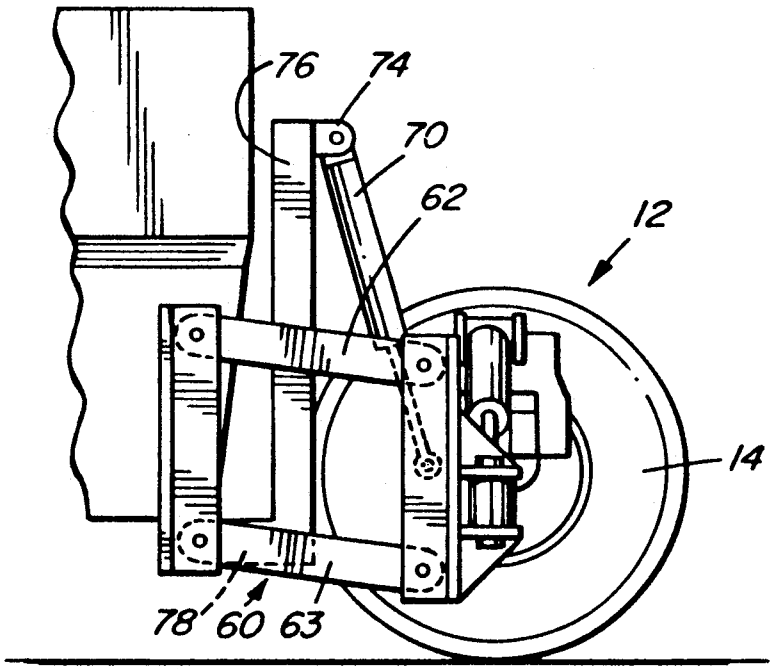
FIG. 7 shows a view corresponding to that of FIG. 6, but with the apparatus in a lowered position.

A hydraulic actuator in the form of a piston and cylinder device 50 is anchored, at one end thereof, to a lug 52 welded to the top of the arm 24 and, at the other end thereof, to a bracket 54 welded to the cross-brace 46. By extension and contraction of the piston and cylinder device 50, the ground engagement member 12 can be adjustably tilted, as illustrated in FIGS. 4 and 5, to raise the ground engagement member 12 from the ground as shown in FIG. 4 and to lower the ground engagement member 12 into engagement with the ground, as shown in FIG. 5. The ground engagement member can thus be urged downwardly against the shoulder of the road, for paving the shoulder, and the provision of the pivot connection 20 provides improved control for packing shoulders having steep inclines.

The upper sheet steel member 32 is formed with a pair of cutouts 56 for receiving the lug 52 on pivotation of the arm 24 from one to the other of its end positions of pivotation.

The backplate 30 is connected to the front of the vehicle 11 by means of a parallel motion linkage, which is indicated generally by reference numeral 60. The parallel motion linkage is formed by upper links 62 and lower links 63, which are connected at opposite ends thereof, by pivot pins 65, to rectangular brackets 66 and 67, which are welded to the rear of the backplate 30, and to the front of a backplate 68, respectively.

A piston and cylinder device 70 is connected between lugs 72 welded to the backplate 30 and lugs 74 welded to the upper end of a post 76. The post 76 is carried on a support 78 extending forwardly from the vehicle 11.

Figure 6:
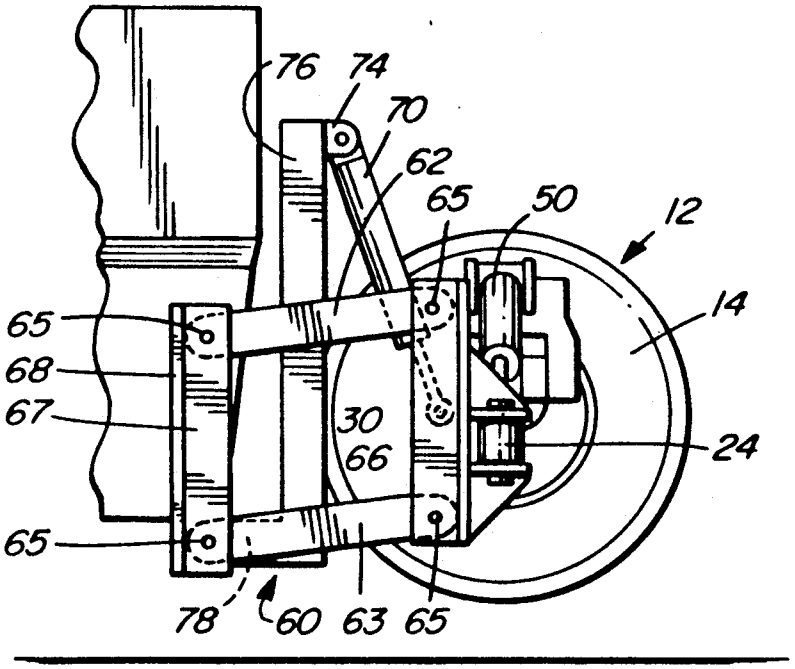
FIG. 6 shows a view in end elevation of parts of the compacting apparatus of FIGS. 1 to 5, in a raised condition.

By contraction of the piston and cylinder device 70, the ground engagement member 12 can be raised from the ground, as illustrated in FIG. 6. Conversely, by extension of the piston and cylinder device 70, the ground engagement member can be lowered onto the ground.

As will be apparent to those skilled in the art, various modifications of the present invention may be made within the scope of the invention as defined in the appended claims.

For example, the assembly comprising the stub shaft 16, the arm 24 and the yoke 48 may be turned upside-down in order to adapt the road shoulder compactor apparatus 10 to different height on the vehicle 10, or on some other vehicle on which the apparatus 10 is mounted.

I claim:

1. A road shoulder compacting apparatus, comprising:

a rotatable ground engagement member for rolling compacting engagement with the ground;

said ground engagement member having an axle;

a support structure for supporting said ground engagement member on a vehicle;

a raising and lowering structure for raising and lowering said support structure relative to the vehicle;

a support arm;

a first pivotal connection between one end of said support arm and said support structure, said first pivotal connection having a substantially vertical axis of pivotation and allowing pivotation of said support arm through an angle of 180° between end positions in which said support arm extends transversely of the apparatus;

a second pivotal connection between the opposite end of said support arm and said axle, said second pivotal connection having a substantially horizontal axis of pivotation; and a hydraulic actuator for pivoting said ground engagement member about said second axis of pivotation relative to said support arm;

said hydraulic actuator being mounted on said support arm for movement therewith; and said support arm having a length sufficient to locate said ground engagement member at a lateral spacing from said support structure, on pivotation of said support arm into its end positions, for compacting a road shoulder.

2. A road shoulder compacting apparatus as claimed in claim 1, wherein said hydraulic actuator comprises a piston and cylinder device connected between said support arm and said axle.

3. A road shoulder compacting apparatus as claimed in claim 2, wherein said support arm has an upturned end portion at said opposite end thereof; said axle comprises a stub shaft having an upturned end portion and said second pivot connection is provided between said upturned end portions; said upturned end portion of said shaft having a lever arm extending upwardly therefrom and said piston and cylinder device being connected to an upper end of said lever arm.

4. A road shoulder compacting apparatus as claimed in claim 1, wherein said support structure includes an elongate arm support at opposite sides of said support structure for supporting said support arm at said opposite end of said support arm when the latter is in its end positions.

5. A road shoulder compacting apparatus as claimed in claim 4, wherein said arm support comprises a channel-shaped structure extending transversely of said apparatus, said channel-shaped structure being horizontally open to allow said support arm to pivot about said vertical axis into and out of said channel-shaped structure.

6. A road shoulder compacting apparatus as claimed in claim 1, wherein said raising and lowering mechanism comprises a parallel motion linkage connecting said support structure to the vehicle and a piston and cylinder device connected between said support structure and the vehicle.

* * * * *